US007469888B2

(12) United States Patent
Clevers

(10) Patent No.: US 7,469,888 B2
(45) Date of Patent: Dec. 30, 2008

(54) TRANSPORTING DEVICE FOR DEPOSITING SHEET MATERIAL ONTO A TRAY, A PRINTER PROVIDED WITH SUCH A DEVICE AND A METHOD FOR DEPOSITING A SHEET MATERIAL ONTO A TRAY

(75) Inventor: Ernest J. J. Clevers, At Horst Aan De Maas (NL)

(73) Assignee: Oce-Technologies B.V., Venlo (NL)

( * ) Notice: Subject to any disclaimer, the term of this patent is extended or adjusted under 35 U.S.C. 154(b) by 354 days.

(21) Appl. No.: 11/032,109

(22) Filed: Jan. 11, 2005

(65) Prior Publication Data

US 2005/0152719 A1 Jul. 14, 2005

(30) Foreign Application Priority Data

Jan. 12, 2004 (EP) ..... 04075013

(51) Int. Cl.
*B65H 29/26* (2006.01)

(52) U.S. Cl. ..... 271/73; 271/189; 414/790.8

(58) Field of Classification Search ..... 271/73, 271/207, 218, 189; 414/790.8, 790.9, 793.3, 414/794.4, 795.2, 792.7
See application file for complete search history.

(56) References Cited

U.S. PATENT DOCUMENTS 563,967 A * 7/1896 Jamieson ..... 271/73
575,643 A * 1/1897 Jamieson ..... 271/73
775,319 A * 11/1904 Taylor ..... 271/73
993,162 A * 5/1911 Freeman ..... 271/73
1,666,246 A * 4/1928 Ranger ..... 101/279
1,983,708 A * 12/1934 Ruble et al. ..... 493/342
2,549,202 A * 4/1951 Idelman ..... 83/89
3,289,815 A * 12/1966 Richter et al. ..... 198/812
3,411,773 A * 11/1968 Cornwall ..... 271/73
3,567,047 A * 3/1971 Clausen et al. ..... 271/176
4,127,264 A * 11/1978 Fayolle ..... 271/191
4,681,003 A * 7/1987 Bernath ..... 83/80
4,712,787 A * 12/1987 Princiotta et al. ..... 271/311
5,803,227 A * 9/1998 Stein et al. ..... 194/206
5,803,706 A * 9/1998 Achelpohl ..... 414/794.4

FOREIGN PATENT DOCUMENTS

CH 359593 A 1/1962
DE 364053 C 11/1922
GB 334438 A 9/1930

* cited by examiner

*Primary Examiner*—Patrick H Mackey
*Assistant Examiner*—Gerald W McClain
(74) *Attorney, Agent, or Firm*—Birch, Stewart, Kolasch & Birch, LLP

(57) ABSTRACT

A transporting device and method for depositing sheet material on a tray, the transporting device including at least two rollers which can be displaced with respect to each other, with a belt extending between the rollers above the tray, the belt being connected at its ends to the two rollers, whereby the belt can be rolled up onto and unrolled from at least one of said rollers.

5 Claims, 2 Drawing Sheets

TRANSPORTING DEVICE FOR DEPOSITING SHEET MATERIAL ONTO A TRAY, A PRINTER PROVIDED WITH SUCH A DEVICE AND A METHOD FOR DEPOSITING A SHEET MATERIAL ONTO A TRAY

This Nonprovisional application claims priority under 35 U.S.C. § 119(a) on Patent Application No. 04075013.5 filed in Europe on Jan. 12, 2004, the entire contents of which are hereby incorporated by reference.

BACKGROUND OF THE INVENTION

The present invention relates to a transporting device for depositing sheet material onto a tray, which includes at least two rollers, which can be displaced with respect to each other, and a belt extending between the rollers above the tray.

The present invention furthermore relates to a printer provided with such a transporting device.

The present invention also relates to a method for depositing a sheet material on a tray by means of a transporting device, which uses at least two rollers, which can be displaced with respect to each other while a belt extends between the rollers above the tray.

A transportation device and method found in U.S. Pat. No. 4,681,003 discloses an endless belt disposed around a relatively large number of rollers, in which two rollers can be displaced with respect to each other. In an initial position a first roller is located relatively close to a second roller, and a first end of sheet material is deposited on the belt extending between the two rollers. From this initial position, the first roller is displaced away from the second roller, whereby the sheet material is supported and transported by said belt. As soon as the first roller reaches a predetermined end position, the first roller is displaced back to the second roller, whereby the sheet material is deposited in the tray.

When the first roller is displaced with respect to the second roller, the endless belt is guided along several deflection rollers, which are movable in a vertical direction for the purpose of equalizing the distance between the first and second rollers as well as for tensioning the belt.

Due to the vertically displaceable rollers, the transportation device has a relatively large height. Furthermore the vertically displaceable rollers make the construction of the transporter relatively complicated.

SUMMARY OF THE INVENTION

It is an object of the present invention to provide a transporting device with a relatively simple configuration. This object is achieved by the transporting device according to the present invention wherein the belt is connected with ends to the two rollers, whereby the belt can be rolled up on and unrolled from at least one of said rollers.

Since the belt is rolled up on and unrolled from at least one of said rollers, the length equalization during displacement of the rollers with respect to each other as well as the tensioning of the belt will be taken care of by means of the same rollers between which the belt extends and on which the sheet material is temporarily being deposited during transport to the tray.

In an embodiment of the transporting device according to the present invention, the belt can be rolled up and unrolled from both rollers. In this manner the belt can be rolled up and unrolled from the rollers in any desirable manner.

In a further embodiment of the transporting device according to the present invention the belt is a wire. By utilizing a wire, a relatively good support surface for a sheet material, e.g., a paper sheet can be provided while the contact surface between the wire and the sheet material is relatively small whereby the risk of contamination of the wire and contamination of the sheet paper by the wire is readily prevented.

In a further embodiment of the transporting device according to the present invention, the rollers and the belt extending between the rollers can be rotated together around an axis extending perpendicular to the longitudinal axis of the belt and the central axes of the rollers. In this manner, the rollers, after rotating over 180°, will be exchanged, whereby the first roller becomes the second roller and the second roller becomes the first roller. If in the initial position the belt is being rolled up on the first roller and needs to be rolled up on the second roller, this can be achieved by exchanging the rollers with respect to each other by rotating them over 180°.

In yet another embodiment of the transporting device according to the present invention, one end of at least one roller is rotatably and displaceably located between two endless belts. By means of these two endless belts, the roller can be rotated as well as transported in two opposite directions by driving the endless belt either in the same or in opposite directions with the same or different velocities. By means of these two endless belts, a relatively simple construction for driving the roller is achieved.

The present invention furthermore relates to a printer, which is provided with such a transporting device. Especially in the case of printers, the relatively thin sheet material of paper on which a print is being applied, needs to be carefully deposited onto a tray or onto previously deposited sheets in said tray whereby sliding of a paper sheet with respect to another paper sheet is prevented. By depositing paper sheets on top of each other instead of sliding the paper sheets over each other, each paper sheet is transported and deposited in the same manner on the tray which improves the predictability of the paper transport system since the paper transport system is no longer determined by the characteristics of, e.g., the type of material, the amount of curl, etc. of previous paper sheets. Furthermore the paper sheet on the belt as well as the previous paper sheet already deposited in the tray has, in case of an inkjet printer, additional time to dry on the belt so that the risk that the print on the paper sheet will be destroyed by the paper sheet deposited thereon, will be reduced or substantially eliminated.

It is a further object of the present invention to provide a method for depositing a sheet material onto a tray, which is simpler and easier than the method according to the prior art. This object is achieved by a method wherein the belt is connected with ends to two rollers and the belt is rolled up on at least one of the rollers in the initial position of the two rollers. Subsequently, the first roller is displaced with respect to the second roller, whereby the belt is unrolled from at least one roller and the sheet material is being supported and transported by the belt until the first roller has received a predetermined end position thereafter, the first roller is displaced back to the second roller whereby the belt is rolled up on one of the rollers, while the sheet material is deposited on the tray.

By the method according to the present invention, the displacement of the rollers with respect to each other as well as the rolling up and unrolling of the belt from at least one of the rollers, causes the displacement of the belt, a length equalization during the displacement of the rollers with respect to each other as well as the tensioning of the belt.

In an embodiment of the method of the present invention, when the first roller is displaced to the predetermined end position, the belt is unrolled from the second roller. In this manner by displacing the first roller to the predetermined position, the belt is also being displaced to the predetermined position, so that the sheet material supported by the belt will automatically be transported in this direction.

In yet another embodiment of the method according to the present invention, when the first roller is being displaced to the predetermined end position, the belt is slightly rolled up on the first roller. In this manner a force is applied by the belt on the sheet material supported thereby which tends to straighten the sheet material on the belt and prevent curling of the sheet material.

In another embodiment of the method according to the present invention, when the first roller is being displaced back to the second roller, the belt is rolled up on the first roller. By rolling up the belt on the first roller, the roller is rolling away underneath the sheet material whereby no forces are applied on the sheet material due to which the sheet material might curl up or being moved.

In yet another embodiment of the method according to the present invention, near the initial position, the belt is unrolled from the first roller and rolled up on the second roller before a new sheet material is transported by the belt. After doing so, the first roller can then be displaced again from the second roller, whereby the belt is unrolled from the second roller to transport a sheet material.

BRIEF DESCRIPTION OF THE DRAWINGS

The present invention will now be further explained with reference to the drawings wherein.

DETAILED DESCRIPTION OF THE INVENTION

Figure 1:
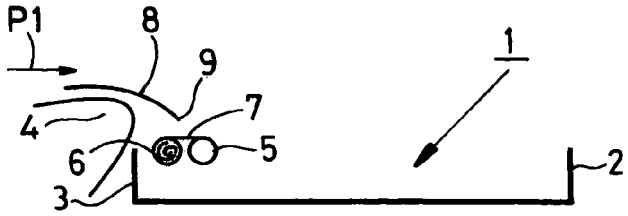
FIGS. 1-6 schematically show several steps of the method according to the present invention for depositing a sheet material by a transporting device according to the invention.

In the drawings, the same elements are provided with the same reference numbers.

Figure 2:
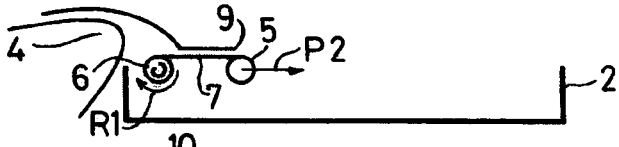
Figure 3:
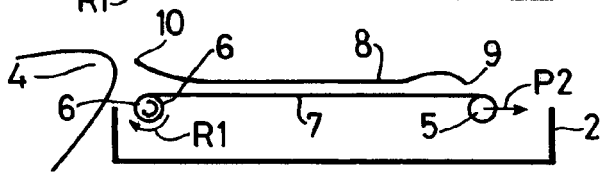
Figure 4:
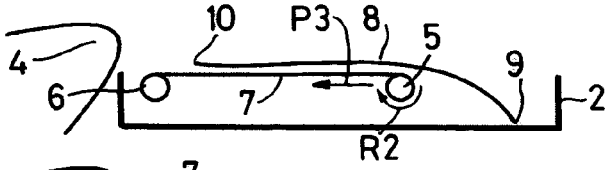

FIG. 1 shows a transporting device 1 according to the present invention for a printer (not shown) which includes a tray 2 located with one end 3 disposed under a paper sheet guiding surface 4 of the printer. The transporting device 1 is furthermore provided with at least one set of rollers 5, 6 and a belt 7 connected at its ends to the rollers 5, 6. The roller 6 is rotatably mounted with respect to a frame (not shown) of the transporting device 1 while roller 5 is rotatably as well as displaceably mounted on the frame with respect to the roller 6. In the situation as shown in FIG. 1, the belt 7 is fully rolled up on the roller 6 when the roller 5 is in its initial position. In this situation a sheet material, e.g., a paper sheet 8, on which a print is to be applied, is moved by the printer in the direction indicated by arrow P1 to the transporting device 1 so that a first end 9 of the paper sheet 8 will contact the belt 7. As soon as the end 9 of the paper sheet 8 is positioned on the belt 7, the first roller 5 is displaced from the roller 6 in a direction indicated by arrow P2, and the second roller 6 is rotated in a direction indicated by arrow R1 to unroll the belt 7. By moving the first roller 5 in the direction indicated by arrow P2, the belt 7 as well as the end 9 of the paper sheet 8 is also transported in this direction (FIG. 2). The first roller 5 is displaced in the direction indicated by arrow P2 until the roller 5 has reached a predetermined end position as shown in FIG. 3. In this position the whole paper sheet 8 is supported by the belt 7 extending between the rollers 5, 6, whereby the first end 9 of the paper sheet 8 is located near the roller 5 while the opposite end 10 is located near the roller 6. To deposit the paper sheet 8 in the tray 2 in which previously deposited paper sheets 8 may already be present, the first roller 5 is rotated in a clockwise direction indicated by arrow R2, the belt 7 is rolled up on the roller 5 while, at the same time, the roller 5 is displaced toward the roller 6 in the direction indicated by arrow P3, opposite to the direction indicated by arrow P2. The roller 6 will not be rotated. Due to the movement of the roller 5, the roller will be rolled away from its underneath support of the paper sheet 8 without applying any force on the paper sheet 8. The first end 9 and subsequently the rest of the paper sheet 8 will now be deposited in the tray 2 (see FIG. 5). The roller 5 will be rotated in the direction indicated by arrow R2 until the belt 7 is fully rolled up on the roller 5 and the roller 5 is again in its initial position.

Figure 6:
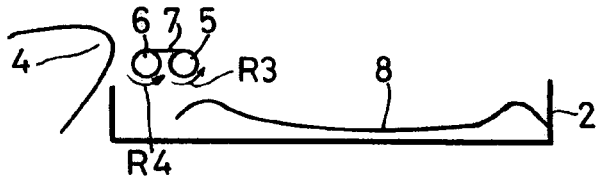

To be able to receive a new paper sheet 8 on the belt 7, transport it and deposit it on the tray 2, the belt 7 needs to be rolled up on the second roller 6 again to receive the start position as shown in FIG. 1. Therefore, as shown in FIG. 6 the rollers 5 and 6 are both rotated counter clockwise in the directions indicated by arrows R3, R4 to unroll the belt 7 from the roller 5 while at the same time rolling up the belt 7 on the roller 6.

Figure 5:
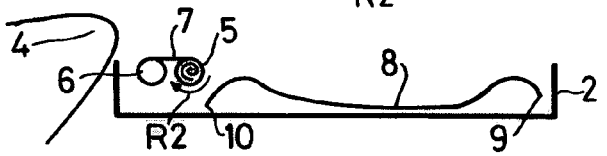
Figure 7:
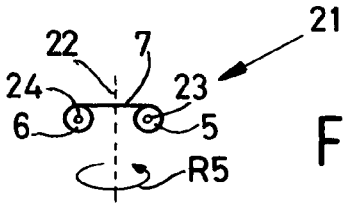
FIG. 7 schematically shows a part of another embodiment of a transporting device according to the present invention.

FIG. 7 shows a part of another transporting device 21 of the present invention whereby the rollers 5, 6 as well as the belt 7 are simultaneously rotatable around an axis 22 in a direction indicated by arrow R5, which axis 22 extends perpendicular to the central axes 23, 24 of the rollers 5, 6 as well as perpendicular to the longitudinal direction of the belt 7. By this embodiment of the transporter 21 the roller 5, 6 as well as the belt 7 will be rotated over 180° in a direction indicated by arrow R5 in the situation as shown in FIG. 5 whereby the whole belt 7 is rolled up on the roller 5. By rotating over 180°, the roller 5 will take up the former position of the roller 6 while the roller 6 will take up the former position of the roller 5. Due to this rotation, the roller 5 provided with the belt 7 can now function as roller 6 while the empty roller 6 can now function as the roller 5. By this embodiment it is not necessary to unroll and roll up the belt as is necessary in the situation as shown in FIG. 6 of the transporting device 1.

Figure 8:
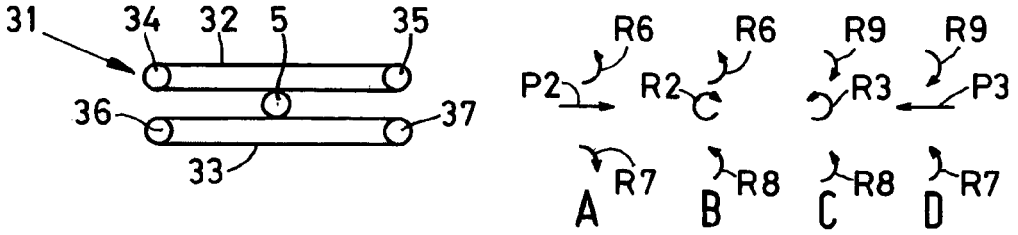
FIG. 8 schematically shows a part of a transporting device according to the present invention for rotating and displacing a roller.
Figure 9:
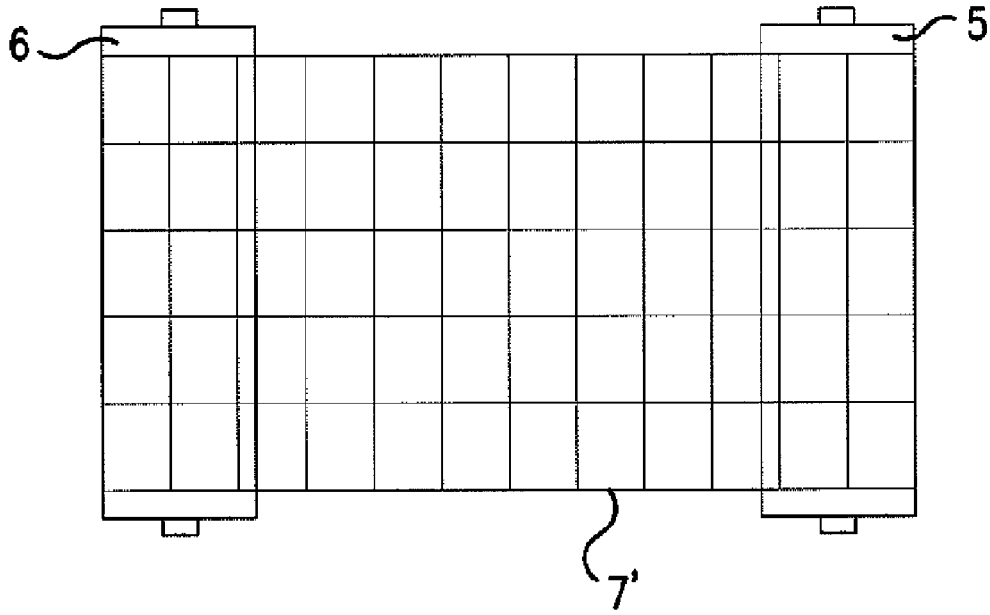
FIG. 9 shows the transporting device of the present invention wherein the belt is a wire.

FIG. 8 shows a part 31 of the transporting device 1 according to the present invention, whereby an end of the roller 5 is located between two endless belts 32, 33 which extend around rollers 34, 35, 36, and 37, respectively. The rollers 34-37 are rotatably mounted with respect to the frame (not shown) of the transporting device 1. If the rollers 35, 37 are rotated in a respectively counter clockwise and clockwise direction indicated by the arrows R6, R7 the roller 5 will, due to friction with the belts 32, 33, move in the direction as indicated by arrow P2. If the rollers 35, 37 are both rotated counter clockwise, as indicated by the arrows R6, R8, the roller 5 will be rotated in a direction indicated by arrow R2. If both rollers 35, 36 are rotated clockwise in a direction indicated by arrows R9, R8, the roller 5 will be rotated counter clockwise, in a direction as indicated by arrow R3. If the rollers 35, 37 are rotated clockwise and counter clockwise, respectively, as indicated by the arrows R9, R7, the roller 5 will be displaced in a direction indicated by arrow P3. By rotating the rollers 35, 36 with different rotational speeds, a combination of a displacement in a direction indicated by arrow P2 or P3 and a rotation in a direction indicated by arrow R2 or R3 can be obtained. In this manner the movement of the roller 5 can easily be controlled.

If desired, the belt 7 might be slightly rolled up on the belt 5 in the situation as shown in FIG. 2 whereby the end 9 of the paper sheet 8 will be pulled in the direction as indicted by arrow P2 whereby the paper sheet 8 will be straightened and prevented from curling.

Preferably two or three sets of rollers 5, 6 are being provided wherein a wire type belt 7' is connected to the rollers 5, 6. However, it is also possible to use relatively long rollers 5, 6, whereby the belt 7 is also relatively wide and will support the paper sheet over the full surface.

It is also possible to use two sets of rollers 5, 6 above each other whereby the belts 7 are directed towards each other and a sheet material like a paper sheet is transported between the two belts 7.

It is also possible that the roller 6 is not rotatable and forms a fixed connection with the printer, whereby the only rotatable roller is roller 5. With this situation, as shown in FIGS. 2 and 3, the roller 5 will then be rotated in a direction as indicated by arrow R3 (FIG. 6) while simultaneously being displaced in a direction indicated by arrow P2. The sheet 8 will not automatically be transported by the belt 7 but needs to be pushed onto the belt 7, for example by the printer. Also roller 5 can be non-rotatable and roller 6 is rotatably connected t the printer.

It is also possible to use wires instead of belts. It is also possible to use only one set of rollers 5, 6 in the case where, for example, the belt 7 is relatively wide.

What is claimed is:

1. A transporting device for depositing sheet material into a tray which comprises at least two rollers, each of which can be displaced relative to the other, disposed above the tray, a belt extending between said rollers, above said tray, said belt being connected at its ends to said rollers, wherein one end of at least one roller is rotatably and displaceably disposed between two endless belts whereby upon the movement of one roller relative to another roller, the belt can be rolled up onto and unrolled from at least one of said rollers.

2. The transporting device of claim 1, wherein the belt can be rolled up and unrolled from each of the rollers.

3. The transporting device of claim 1, wherein the belt is a wire.

4. The transporting device of claim 1, wherein the rollers and the belt extending between the rollers can be rotated together around an axis extending perpendicular to the longitudinal axis of the belt and the central axes of the rollers.

5. A printer provided with the transporting device of claim 1.

* * * * *